United States Patent [19]

Braschler

[11] Patent Number: 4,580,974

[45] Date of Patent: Apr. 8, 1986

[54] MELTING FURNACE COVER

[75] Inventor: Ronald F. Braschler, Thornville, Ohio

[73] Assignee: Kaiser Aluminum & Chemical Corporation, Oakland, Calif.

[21] Appl. No.: 720,326

[22] Filed: Apr. 5, 1985

[51] Int. Cl.[4] ..... F27D 1/18; F27D 1/12; F23M 7/00; F23M 5/06

[52] U.S. Cl. ..... 432/250; 110/173 A; 110/332; 432/237

[58] Field of Search ..... 432/237, 250; 110/173, 110/173 A, 332

[56] References Cited

U.S. PATENT DOCUMENTS

| | | | |
|---|---|---|---|
| 2,091,224 | 8/1937 | Brinckerhoff et al. | 110/173 A |
| 3,293,346 | 12/1966 | Rumberg et al. | 373/73 |
| 3,385,241 | 5/1968 | Alvis et al. | 110/335 |
| 4,146,742 | 5/1979 | Longenecker | 13/35 |
| 4,183,305 | 1/1980 | Payne | 110/173 A |
| 4,287,839 | 9/1981 | Severin et al. | 110/331 |
| 4,411,621 | 10/1983 | Miller | 432/247 |
| 4,445,220 | 4/1984 | Kuhlmann | 373/74 |
| 4,524,702 | 6/1985 | Miller et al. | 110/173 A |

OTHER PUBLICATIONS

Industrial Furnace Services Inc., undated Brochures entitled "Cover Your Assets" and We've Created A Monster.

*Primary Examiner*—John J. Camby
*Attorney, Agent, or Firm*—Malcolm McQuarrie

[57] ABSTRACT

A cover for a top charged melting furnace includes an annular ring of downwardly extending blocks or modules of ceramic fiber insulating material. A plurality of T-bar anchors cooperate with the blocks to provide an anchor system for the annular ring. This anchor system allows the ring's attachment to the cover to be tightened in compensation for heat and compressionally related block size reductions. The anchoring system prevents the ring of blocks from sagging during cover elevation while not interfering with upward movement of the blocks during cover positioning on the furnace. The annular ring of blocks protects the main portion of the cover's insulation from damage and any damaged blocks in the ring are readily replaceable.

17 Claims, 4 Drawing Figures

MELTING FURNACE COVER

FIELD OF THE INVENTION

The present invention is directed generally to a cover for a top charged melting furnace. More specifically, the present invention is directed a to light weight top charged melting furnace lid utilizing ceramic fiber. Most particularly, the present invention is directed to a low mass cover for a top charged melting furnace with the cover having an outer ring of downwardly extending modules of insulative material. The outer, downwardly extending ring of fiber modules mates with the upper surface of the furnace sidewall to provide a proper closure. The ring of modules is secured to the furnace cover by an anchoring system which provides compensation for thermally or otherwise caused module size changes. Should one of the modules which form the ring become damaged during furnace charging or lid movement, it can be quickly and easily replaced.

DESCRIPTION OF THE PRIOR ART

Top charged melting furnaces are generally well known in the art. Typically a furnace of this type is in the form of a generally cylindrical vessel or structure having an open top or mouth that can be closed with a lid or cover. In the aluminum industry these top charged melting or remelting furnaces are used to remelt large blocks of aluminum and to alloy the aluminum with other metals to form an aluminum alloy which is then cast into alloyed ingots. Not only are aluminum blocks and other alloying metals placed in the remelt furnace, also added may be pieces of scrap and the like.

A substantial amount of energy is required to melt the aluminum in the furnace and to maintain it at an elevated temperature during processing. Accordingly, the typical melting furnace is highly insulated. Since the lid or cover assembly is a part of the furnace assembly, it should also be well insulated. In the prior art, this insulation of the furnace has usually been in the form of refractory material. Similar material has been used to insulate the cover or lid thus rendering it thick, heavy, hard to handle, and cumbersome. Furthermore, the refractory material requires a substantial amount of energy to warm it up and to keep it hot so that a considerable amount of energy is used heating and reheating the cover which may be removed several times during a typical furnace cycle.

As the name implies, a top charged furnace is charged or loaded through its top. A remelt furnace used for aluminum may be in excess of 20 feet in diameter so that the lid or cover is even larger than that. In the usual installation, a cover crane is used to raise the lid up and off the mouth of the furnace and to move it horizontally away so that materials can be put in the furnace. The thicker the refractory insulation material used on the lid, the heavier the lid will be and the bigger the cover crane required to lift it. As crane size increases, so do associated first costs, maintenance costs, and operating costs.

Various attempted solutions to the problems presented by the prior art refractory furnace lid assemblies have been proposed by the industry. In one of these, a plurality of modules of fiber insulation were attached to a metal furnace lid. However, these proved unsatisfactory since they tended to shrink and fall. A more acceptable solution has been found to the problem of providing a light weight insulated cover for a top charged aluminum melting furnace by using a construction such as is shown in U.S. Pat. No. 4,411,621 to Miller. In this cover assembly, U-shaped mats of ceramic fiber insulating material are attached to an expanded sheet metal member to form a module which can be attached to the furnace lid. Materials of this type are commerically available from Industrial Furnace Services, Inc. of Streetsboro, Ohio and are known as IFSI Monster Modules TM.

While these one piece mats of ceramic fiber insulating materials provide a cover or lid that is far superior to the prior refractory cover assemblies, several problems remain. As was previously mentioned, not only are blocks of aluminum placed in a furnace but pieces of scrap and other irregular shapes are also charged to the furnace. If one of these pieces protrudes above the mouth of the furnace, it may contact the lid as it is moved back into place over the furnace. The sharp metal in the furnace is apt to tear the ceramic fiber insulating material thus possibly exposing the metal lid to the hot interior of the furnace and also contaminating the melt with particles of insulation. While the obvious solution is to increase the spacing between the furnace and the lid during lid transport, this is often not practical or even possible due to overhead clearance restrictions, crane capabilities and other size constraints. Once the one piece ceramic fiber insulating cover liner is damaged, it is expensive and time consuming to repair or replace.

During charging of the furnace or during its operating cycle when additional constituents are added to the melt, molten metal is apt to be deposited on the upper surface of the furnace sidewall. Once this material solidifies, or if solid debris is dropped on the upper surface of the furnace sidewall, it forms a projection that can contact the ceramic fiber insulating material and damage it. Gaps or voids formed in the insulating blanket can allow hot gases and products of combustion to leak out.

While the ceramic fiber insulating material assemblies recently proposed for furnace lids are superior to the prior refractory materials, a need exists for a melting furnace cover assembly that is practical, usable in industrial applications, that provides a means for allowing fast, inexpensive repairs of the ceramic fiber insulating material and which further allows for compensation for heat shrinkage of the ceramic insulating material.

SUMMARY OF THE INVENTION

It is an object of the present invention to provide a lid for a top charged melting furnace.

Another object of the present invention is to provide a light weight cover for a top charged melting furnace.

A further object of the present invention is to provide a cover for a top charged melting furnace that uses ceramic fiber insulating material.

Still another object of the present invention is to provide a cover assembly including a downwardly extending, peripheral ring of ceramic fiber insulating modules.

Yet a further object of the present invention is to provide a cover for a top charged melting furnace utilizing adjustable anchors for the insulation modules.

Still yet another object of the present invention is to provide a ceramic fiber insulated cover for a top charged melting furnace that maintains the structural integrity of the mating surface of the cover and the upper surface of the furnace sidewalls.

An even further object of the present invention is to provide an insulated cover assembly in which the cover's insulation is quickly and easily repaired if damaged.

Even yet another object of the present invention is to provide an insulated cover assembly including a downwardly extending ring of ceramic fiber insulating modules whose improved insulating qualities eliminate the need for water cooling of the cover's encircling ring.

As will be set forth in greater detail in the description of the preferred embodiment, the cover assembly for a top charged melting furnace in accordance with the present invention is generally a flat circular expanded or unexpanded metal member to whose undersurface is secured a blanket or mat of ceramic fiber insulating material. At the periphery of the cover there is located a downwardly extending annulus or ring of ceramic insulating fiber modules. These are supported from the top of the cover by a plurality of generally inverted T-shaped steel bars. These bars are used to form an anchoring system for the ring of modules.

The cover assembly in accordance with the present invention is as effective as the prior art refractory covers while being significantly lighter and easier to handle. The ceramic fiber insulating material does not require a large amount of heat to warm it up initially and to rewarm it each time it is removed and then replaced during an operating cycle of the melting furnace. Further, since the cover is light in weight, it can be moved more rapidly and with a much lighter capacity crane than was required by prior refractory covers or lids.

The downwardly extending peripheral ring of modules that are placed on the cover assembly in accordance with the present invention are essentially sacrificial in nature. Since it is realistically not practical to increase the height above the furnace to which the cover can be raised during transport, it is inevitable that the cover will contact metal protruding from the furnace mouth. Since the downwardly extending peripheral ring is the lowest portion of the cover, it will be the first portion of the cover to contact any obstructions in its path. This contact will be apt to damage the particular module, but since the ring is made up of a large number of these modules, removal and replacement of a damaged module is not overly difficult and is certainly easier than replacement of an entire cover undersurface as would be the case if the peripheral modular ring were not utilized.

The outer, downwardly extending peripheral ring of ceramic fiber modules in accordance with the present invention is secured to the cover or lid through the use of a plurality of inverted, generally T-shaped alloy steel bars. These T-bar anchors are moveable only in the upward direction with respect to the metal portion of the cover. As the cover is lifted up during removal, the modules are pulled downwardly by gravity and try to separate from the cover steel structure. These T-shaped anchors prevent such movement and also can be tightened to compensate for heat induced shrinkage of the modules. When the cover is again lowered onto the upper surface of the furnace sidewall, the modules can move upwardly due to compressional forces or any obstruction that may be present on the upper furnace wall surface. The T-bar anchors are free to move vertically upwardly and thus eliminate or minimize any damage which might be done to the ceramic fiber insulation modules that make up the ring portion of the cover.

A further benefit afforded by the ceramic fiber insulated cover for a top charged melting furnace in accordance with the present invention is simplicity of construction and operation. The downwardly extending annular ring and the balance of the cover's insulation are quite effective insulating means and eliminate the need for coolant liquid flow lines in the cover. Prior art refractory covers became hot enough that it was necessary to cool the supporting structural steel members. Without the need for such coolant lines, the subject cover assembly is significantly less complex.

The ceramic fiber insulated cover for a top charged melting furance in accordance with the present invention is effective, light weight, easily handled and relatively maintenance free. The downwardly extending ring of ceramic fiber modules protects the main insulated portion of the cover and individual modules are easily removed and replaced, if damaged. The use of the T-shaped mounting anchors prevents the modules from sagging downwardly, allows adjustment of the ring to compensate for temperature and compressional shrinkage of the modules, and allows upward movement of the modules without damage. The cover assembly in accordance with the present invention provides a practical, workable top charged melting furnace lid which will meet the demands of the industry in an effective manner.

BRIEF DESCRIPTION OF THE DRAWINGS

While the novel features of the melting furnace cover in accordance with the present invention are set forth with particularity in the appended claims, a full and complete understanding of the invention may be had by referring to the detailed description of a preferred embodiment as is set forth hereinafter, and as may be seen in the accompanying drawings in which:

DESCRIPTION OF THE PREFERRED EMBODIMENT

Figure 1:
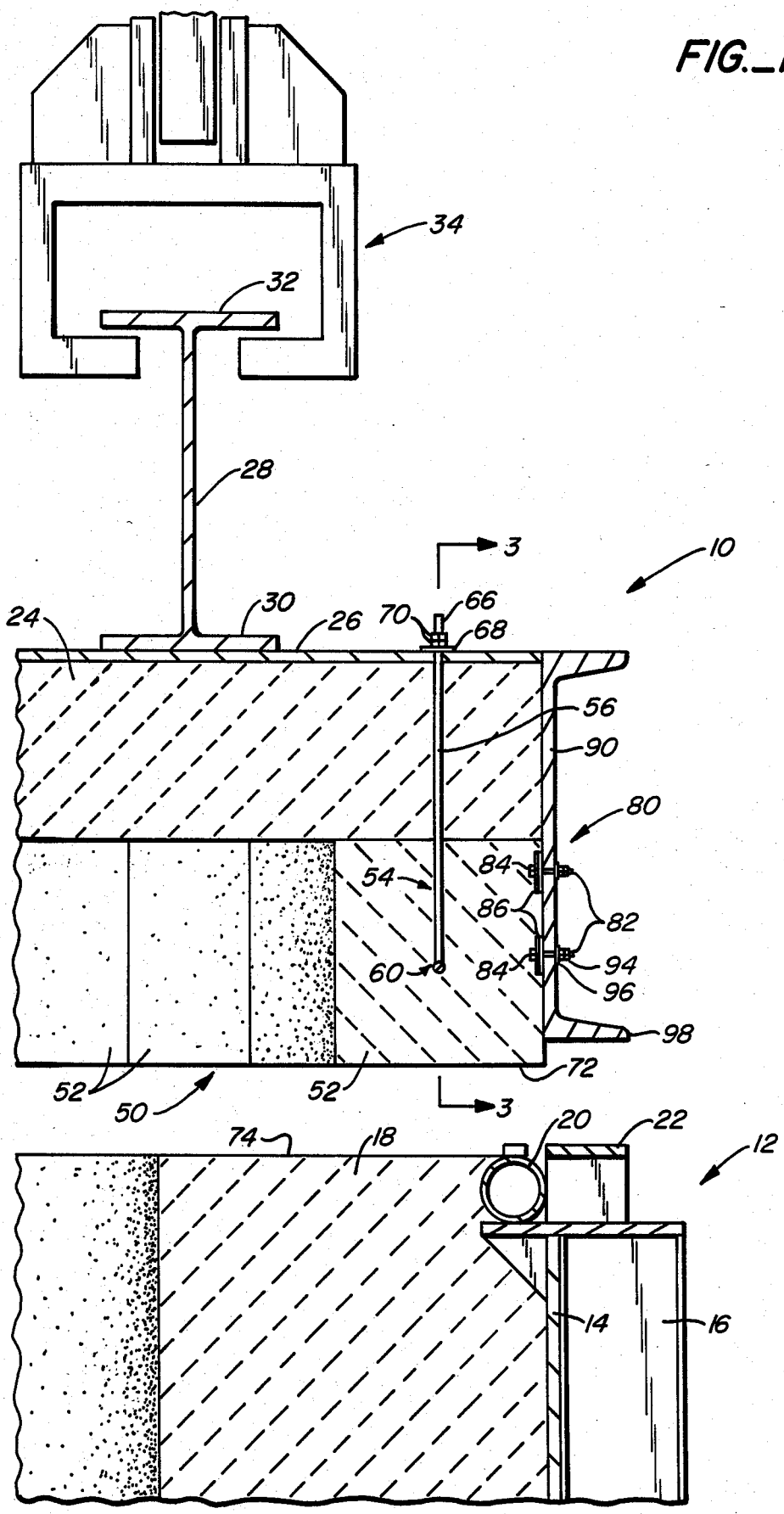
FIG. 1 is a partial side elevation view, partly in section of a preferred embodiment of a melting furnace cover in accordance with the present invention and showing the cover elevated above the furnace.

Turning initially to FIG. 1, there may be seen generally at 10 a preferred embodiment of a melting furnace cover assembly in accordance with the present invention. As was discussed previously, cover assembly 10 is intended for use in conjunction with a top charged melting furnace, a portion of which is shown generally at 12 in FIG. 1. While top charged melting furnaces are generally known in the art, a brief review of their structure and function will be helpful in understanding the subject invention. A typical furnace is generally in the shape of an upright cylinder and has a steel or other metal shell 14 which is provided with exterior steel structural support members, such as shown at 16. The upper interior sidewall of the furnace is provided with a lining 18 of a generally conventional refractory material. Coolant liquid piping 20 is placed at the upper, outer portion of the furnace's upper refractory sidewall.

A cover support ring 22 is positioned atop the sidewall of the furnace 12 for cooperation with the cover assembly 10. As is known in the art, these top charged remelt furnaces may be in excess of 20 feet in diameter and are used to remelt previously formed aluminum blocks so that the metal can be alloyed with various other metals and other possible constituents to be reformed into alloyed ingots. During the charging of the furnace with the aluminum blocks and other constituents, and during the remelt process, it is necessary to open and re-cover the furnace. The cover assembly 10 is provided for this purpose.

The cover assembly, generally at 10, is generally disk shaped with the horizontal planar portion of the disk being comprised of a ceramic fiber insulating material, shown somewhat schematically at 24 in FIG. 1. Insulating material 24 is secured to an overlying metal framework, again schematically indicated at 26 in FIG. 1. This framework, may be a solid metal plate, or may be an expanded metal framework. A plurality of steel I beams, one of which is shown at 28 in FIG. 1 are secured to the upper surface of metal framework 26, typically by welding or otherwise attaching the framework 26 to a lower flange 30 of I-beam 28. The upper flange 32 of I-beam 28 is engagable by a lifting clamp or hook assembly 34 which is a portion of a generally well known cover crane assembly (not shown) which will not be discussed in detail. As is well known in the art, the cover crane is used to raise and lower cover assembly 10 once the lifting clamp or hook assembly 34 has grasped upper flange 32 of I-beam 28. Once the cover 10 has been raised above furnace 12, it is moved horizontally away from the furnace to allow charging of the furnace.

Figure 2:
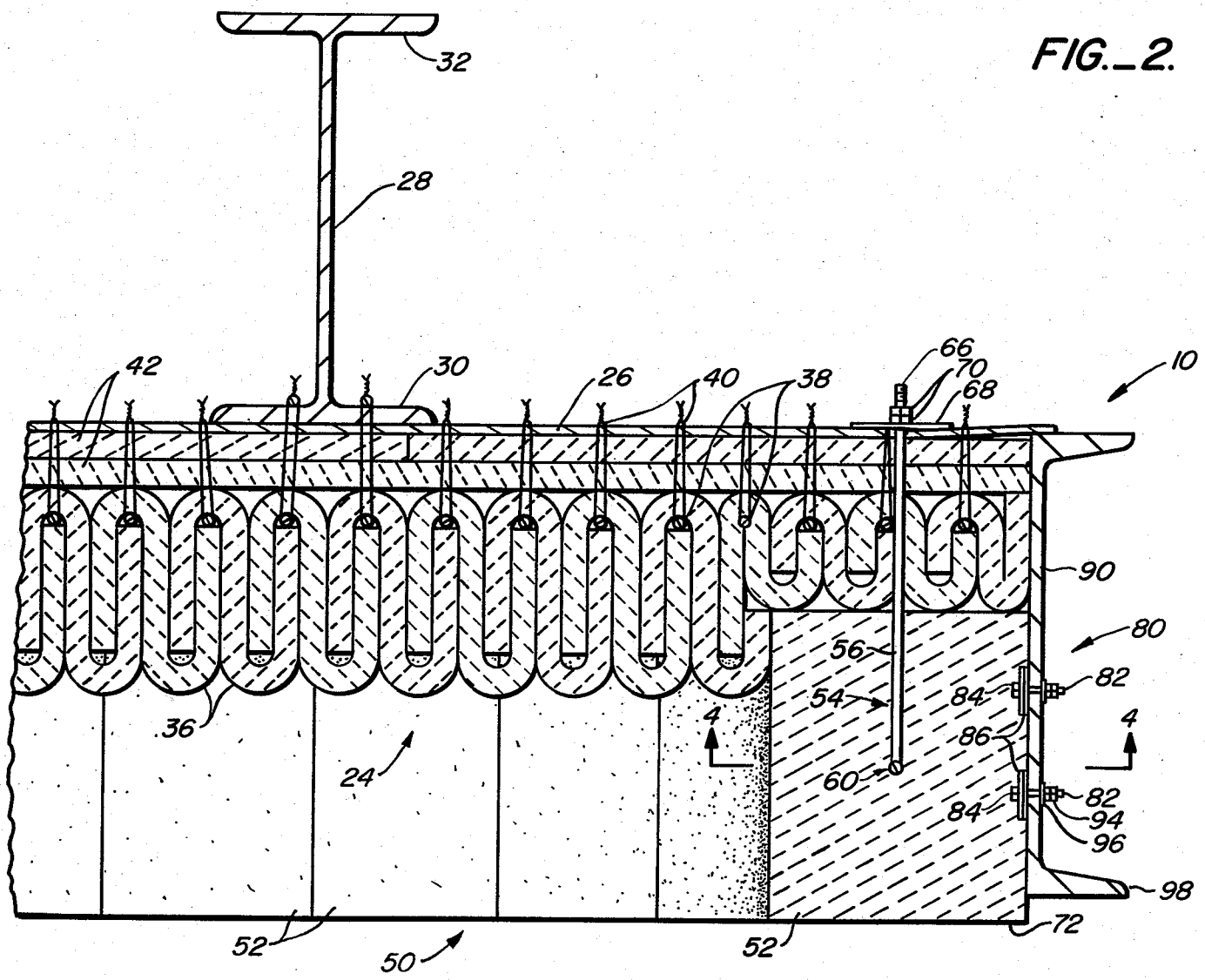
FIG. 2 is a partial side elevation view of the cover assembly of the present invention.

In FIG. 1, the ceramic fiber insulating material 24 is shown somewhat schematically and it will be understood that any suitable type of such material, which is commerically available, is usable on cover assembly 10. FIG. 2 depicts the utilization of one such commerically available modular ceramic fiber insulating mat for cover assembly 10. This mat is available from Industrial Furnace Services, Inc. of Streetsboro, Ohio and is of the type set forth generally in U.S. Pat. No. 4,411,621. While this mat assembly is discussed in detail in the above-identified patent, its use in cover 10 will be briefly reviewed. As may be seen in FIG. 2, the mat assembly 24 is comprised generally of a plurality of interleaved mats 36 of ceramic fiber insulating material which are interposed over support rods 38. Rods 38 are secured to metal framework 26, which in this case is an expanded metal member, by a plurality of tie wires 40 that pass around the support rod and through the apertures in the expanded metal member 26. A plurality of generally planar bats 42 of ceramic insulating material can be placed between the generally U- or sinusoidal shaped mats 36 and the expanded metal framework 26 if desired.

A downwardly extending ring of ceramic fiber insulating modules, generally at 50, may be seen in FIGS. 1 and 2 positioned at the outer periphery of cover assembly 10. This ring 50 is comprised of a plurality of individual blocks or modules 52 of ceramic fiber insulation which are commerically available. These blocks 52 are capable of withstanding temperatures up to 2600° F. and in the preferred embodiment are generally 12 inches long, 12 inches high and 10 inches thick.

Blocks 52 of ceramic fiber insulating materials are supported from the metal framework 26 that forms the top of cover assembly 10 by a plurality of spaced, inverted T-shaped alloy steel support bars 54 as may be seen in FIGS. 1–4. As may be seen most clearly in FIG. 3 , each T-bar 54 is comprised of a generally vertical shank 56 which terminates at a first or lower end 58 in a generally horizontal insulating-block-engaging arm 60. Each arm 60 extends equidistantly as two arm segments 62 on either side of vertical shank 56 and with each arm segment 62 being positioned in a bore 64 formed in each insulating block 52.

Figure 3:
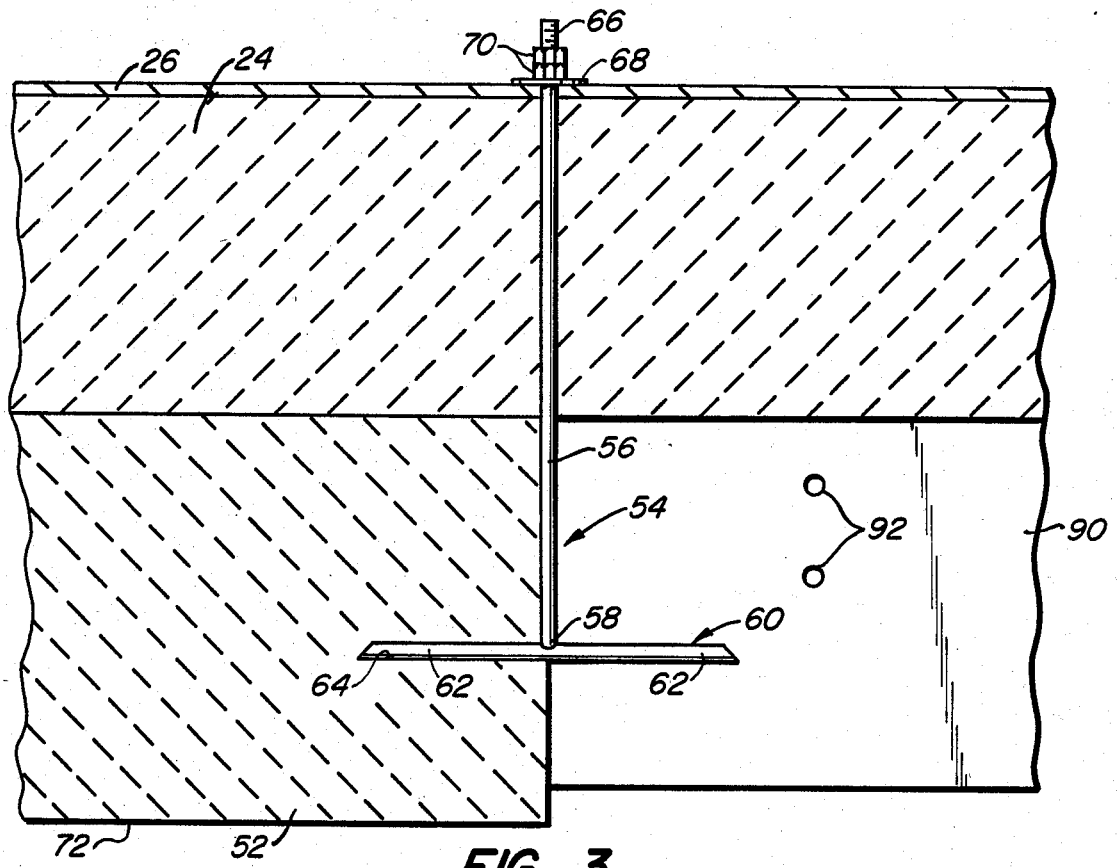
FIG. 3 is a sectional view of a portion of the cover assembly taken along line III—III of FIG. 1.
Figure 4:
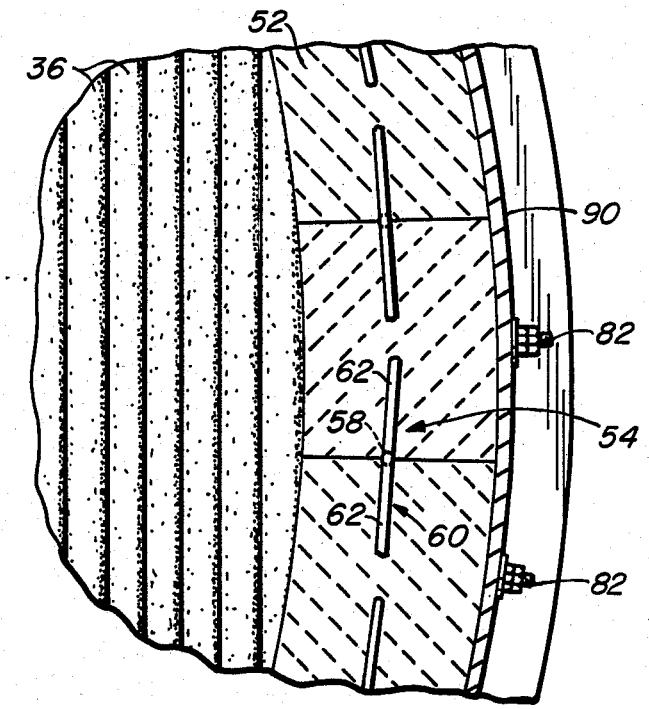
FIG. 4 is a sectional view of a portion of the cover assembly taken along line IV—IV of FIG. 2.

As can be seen in FIGS. 3 and 4, each shank 56 is placed between two adjacent blocks 52 and extends vertically upwardly beyond adjacent blocks 52, through insulative mat 24, further upwardly through metal framework 26 of cover 10 and to a threaded second or upper end 66. An enlarged flat support washer 68 is slid down over threaded upper end 66 of shank 56 of T-bar 54 and bears against the upper surface of the metal framework 26. A pair of nuts 70 are then secured on threaded shank 56.

This anchor assembly performs several very important functions which allows the cover assembly in accordance with the present invention to work well. When the cover assembly is first put into service, the elevated temperature to which the insulating blocks 52 are exposed, causes them to shrink and contract slightly. Tightening of nuts 70 draws T-bar anchor 54 upwardly to compensate for such heat related shrinkage. When the top assembly 10 is lowered onto the furnace 12, contact between a lower surface 72 of each block 52 of the annular ring assembly 50 with an upper surface 74 of the upper refractory lining 18 of furnace 12 also causes the ceramic blocks 52 to compress slightly. This is also compensated for by tightening of nuts 70. Once these initial heat and compressional shrinkages of blocks 52 have taken place, adjustments to nuts 70 are no longer required. When the cover assembly is elevated during furnace operations, the force of gravity will act to attempt to pull the blocks 52 of annular ring 50 downwardly. Such motion of the blocks 52 is prevented by the T-bar anchors 54 which will not allow the blocks to sag downwardly. When the cover 10 is lowered back down onto furnace 12, any molten metal which may have splashed onto the upper surface 74 of refractory 18 and solidified or any other material inadvertently left on surface 74 will tend to force the block 52 which contacts it upwardly. Since the T-bar anchors 54 are free to move vertically upwardly, they will not interfere with movement of the blocks 52 in this direction. Blocks 52 are thus able to move upwardly in compression to form a tight seal between the top assembly 10 and the furnace wall 18.

The annular ring 50 of blocks 52 of ceramic fiber insulating material are also secured at their outer peripheries to an encircling structural cover ring or band 80. Each module block 52 carries a pair of spaced bolts 82 whose heads 84 are secured in metal straps 86 found in the outer peripheral surfaces of blocks 52. Cover ring or band 80 is generally in the shape of a steel channel having a central web 90 which, as may be seen in FIG. 3, is provided with spaced apertures 92 through which bolts 82 on blocks 52 pass. Alternatively, structural cover ring or band 80 may be formed of an expanded metal mesh central web having angle iron flanges and spaced generally vertical reinforcing gussets. Nuts and washers 94 and 96, respectively, are used to secure blocks 52 to cover band or ring 80. A lower support flange 98 of cover ring 80 cooperates with cover support ring 22 of furnace 12 to aid in supporting the cover assembly 10 on the furnace 12. Cooperation of support flange 98 with support ring 22 also limits downward travel of cover assembly 10 and thus limits compression of modules 52.

As was also discussed previously, the downwardly extending annular ring 50 of blocks 52 is somewhat sacrificial in nature. If a piece of metal is protruding above the upper portion of furnace 12 after furnace charging, or if debris or solidified metal is located on upper surface 74 of refractory 18, the downwardly extending ring 50, being the lowest portion of the cover, will contact the protruding metal or scrap. If one or more of the blocks 52 are damaged or destroyed, it is relatively easy to replace them. This is certainly less difficult, and much less expensive than would be the case were the ring not provided. As can be readily appreciated, the ceramic fiber insulating assembly 24 secured to the undersurface of cover assembly 10 does not easily avail itself of repair or replacement of a section should it be damaged. Again, it is the ease of repair and replacement afforded each block 52 of ring 50 by T-bars 54 that makes the cover assembly 10 in accordance with the present invention a practical, commerically usable assembly.

While a preferred embodiment of a melting furnace cover in accordance with the present invention has been set forth fully and completely hereinabove, it will be obvious to one of ordinary skill in the art that a number of changes in, for example, the size of the furnace and cover, the composition of the ceramic fiber insulation, the furnace sidewall structure, the type of ceramic fiber insulating material applied to the undersurface of the cover, and the like, could be made without departing from the true spirit and scope of the subject invention which is accordingly to be limited only by the following claims.

What is claimed:

1. A cover assembly for a top charged melting furnace, said cover assembly comprising:

a generally planar metal framework;

a layer of light weight insulating material secured to an undersurface portion of said framework;

an annular downwardly extending ring of insulating blocks positioned generally at a peripheral portion of said framework; and means for securing said ring of blocks to said cover, said securing means permitting upward compressive movement of the insulating blocks in the annular ring.

2. The cover assembly of claim 1 wherein said means for securing said insulating blocks includes a plurality of T-bars.

3. The cover assembly of claim 2 wherein each of said T-bars includes a generally vertical shank and a generally horiziontal arm secured at a first end of said shank.

4. The cover assembly of claim 3 wherein each of said T-bars is positioned between adjacent ones of said blocks in said ring.

5. The cover assembly of claim 4 wherein each of said arms includes arm segments extending in opposed directions from said shank.

6. The cover assembly of claim 5 further wherein each of said arm segments is receivable in a bore in one of said blocks.

7. The cover assembly of claim 3 wherein said shank includes a second threaded end that projects above said metal framework.

8. The cover assembly of claim 7 wherein a washer is carried on said threaded shank above said metal framework.

9. The cover assembly of claim 7 wherein said shank carries one or more nuts on said threaded end above said framework.

10. The cover assembly of claim 7 wherein said shank is freely slidable vertically upwardly through said metal framework.

11. The cover assembly of claim 1 further including a cover band encircling an outer periphery of said ring of insulating blocks.

12. The cover assembly of claim 11 wherein each of said insulating blocks is secured to said cover band.

13. The cover assembly of claim 12 wherein each of said insulating blocks includes at least two spaced bolts which pass outwardly through apertures in said cover band.

14. A cover assembly for a top charged melting furnace, said cover assembly comprising:

a generally planar disk shaped metal frame;

a ceramic fiber insulating assembly secured to an undersurface portion of said metal frame;

an annular ring of a plurality of ceramic fiber insulating blocks secured to said metal frame generally at a peripheral portion thereof;

a plurality of spaced T-bar anchors for said plurality of blocks, each of said T-bars having a generally vertical shank which carries generally horizontal block engaging arm segments at a first end and a threaded second end which passes upwardly through said metal frame, said T-bars permitting upward compressive movement of the insulating blocks in the annular ring; and a cover band encircling said annular ring of blocks, each of said blocks being secured to said band.

15. The cover assembly of claim 14 wherein said metal frame is expanded metal.

16. The cover assembly of claim 14 wherein said cover band includes a lower support ring engagable with an upper support ring of the melting furnace.

17. The cover assembly of claim 14 wherein said shanks of said T-bar anchors are restrained from downward motion through said metal frame by an enlarged washer interposed between said metal frame and one or more nuts secured to said threaded shank.

* * * * *